United States Patent [19]

Evans, III

[11] Patent Number: 4,840,217

[45] Date of Patent: Jun. 20, 1989

[54] PET PORTAL

[76] Inventor: Richard Evans, III, Box 23-C Bay Rd., Bowdoinham, Me. 04008

[21] Appl. No.: 191,432

[22] Filed: May 9, 1988

[51] Int. Cl.[4] ..... E05D 7/00

[52] U.S. Cl. ..... 160/368.1; 160/180; 49/67; 49/169

[58] Field of Search ..... 160/116, 117, 368.1, 160/354, 180, 181, 90; 49/168, 169, 67; 16/225; 119/19, 15

[56] References Cited

U.S. PATENT DOCUMENTS

| | | | |
|---|---|---|---|
| 2,758,646 | 8/1956 | Johnson | 160/354 |
| 2,871,523 | 2/1959 | Negoro | 49/67 X |
| 3,091,221 | 5/1963 | Worm | 119/19 |
| 3,874,118 | 4/1975 | Robinson | 49/169 X |

FOREIGN PATENT DOCUMENTS

| | | | |
|---|---|---|---|
| 256693 | 2/1965 | Australia | 49/67 |
| 1567001 | 5/1980 | United Kingdom | 49/169 |

*Primary Examiner*—Blair M. Johnson
*Attorney, Agent, or Firm*—Thomas L. Bohan

[57] ABSTRACT

A structure permitting pets separate passage between a household and the out-of-doors, comprising a succession of weathertight doors which the animal must traverse independently and consecutively and for which the household pet must be trained. An animal approaching the structure from the outside is not exposed to any draft or odor emanating from the interior of the house and, furthermore, is initially presented with a door that only opens backward toward itself and up; consequently, strange animals—those not trained to the structure—are not induced to enter.

3 Claims, 1 Drawing Sheet

PET PORTAL

BACKGROUND OF THE INVENTION

1. Technical Field

My invention relates to apparatus designed to provide family pets such as cats, dogs, and ferrets with simple and independent yet controlled access to the family home.

2. Background Art

Owners of pet animals have long experimented with various designs of pet entrances to allow their pets independent egress and ingress to the family household. The prior art in the field reflects this experimentation as well as several limitations in the results.

Pet entrances are normally attached at ground level to either an exterior door or wall of the pet owner's home and are designed to be normally closed when not being utilized by the animal. To maintain the normally-closed position, a variety of mechanisms, including springs, elastic doors, and magnetic catches have been used. Although the pet entrance is analogous to the exterior door used by humans for passage into and out of the house, all such pet entrances described in the prior art lack an essential element needed to complete the analogy: a simple means of excluding strangers. The addition of a lock and key to a household's exterior door restricts passage to members of the household and to those authorized by said members. In contrast, the pet entrances described in the prior art normally present any curious animal with easy access to the household interior, provided only that the curious animal is sufficiently small. The sole prior attempt known to the inventor to address this problem utilizes a magnetically-actuated pet door in combination with a magnet-collar to be worn by the pet, as taught by Beckett et al. in "Magnetically Actuated Cat Door", U.S. Pat. No. 4,022,263. Although a partial solution to the stray animal problem, the device of Beckett et al. is a relatively complicated arrangement and is also subject to failure as the result of the pet losing its magnet. In contrast, the present invention utilizes the simplest of designs and depends for the functioning of its lock and key feature upon the pet animal remembering what it has been helped to learn. It is seen that such a simple means of eliminating the stray animal drawback to pet doors constitutes a useful invention and a significant improvement over the prior art. Attention is called to U.S. Pat. Nos. 229,502, 2,758,646, 3,184,803, 3,690,299, 4,022,263, 4,359,198, 4,399,771.

DISCLOSURE OF THE INVENTION

The present invention, the Pet Portal, has two novel features. The first is the means by which it provides easy passage to the pet animal trained in its use while excluding all other animals. The second is the simple yet effective means by which it maintains a weather-tight seal when not in use. As will be set out below, the functioning of the first is dependent in part upon the operation of the latter.

The heart of the invention is the requirement imposed by the Pet Portal that the entering pet open and pass through a series of at least two doors in order to gain entrance to the household in which the Pet Portal is installed, and the concomitant requirement that each of said series of doors is by itself capable of maintaining a seal which is effectively airtight. To open the first such door encountered during its traverse of the Pet Portal, the animal has to lift the door back toward itself and upward, utilizing its nose or paw. It then has to traverse a passageway ranging up to several feet in length before passing through the final door, against which it simply pushes its nose in order to reach the household interior. Said doors are all hung from above by means of a soft and flexible hinge such as lightweight carpeting material backed by a resilient layer. In each instance the surface against which the door is closed makes an angle with the vertical in such a fashion that said door in its relaxed position is held flush against said opening by the force of gravity, said door being sufficiently heavy that a tight seal is formed. The presence of wind serves to shut one or the other of said doors even more tightly, the door affected being dependent on the direction of the pressure gradient said wind creates between the interior and exterior, respectively, of the enclosed structure in which the Pet Portal is installed. To maintain a planar surface at the interface between said doors and the surface against which said doors close, a stiff planar element is centrally affixed to the outside surface of said doors. Said planar element gives shape to the otherwise flexible flap of carpet-like material constituting the soft resilient surface which, when pressed against the openings of said passageway, forms the effectively airtight seal. "Effectively airtight" in this context means that no sensible air currents or drafts will be able to pass through that seal. (This contrasts with most of the prior art for which the usual pressure differentials existing between the interior and the exterior of an enclosed structure will cause air currents to flow in one direction or the other.) Because of said seal, household odors will also be interdicted when said Pet Portal doors are in their normal closed configuration.

Dogs and cats and other small animals are notoriously curious and tend to poke their noses into openings and potential openings in buildings. In their attempts to enlarge potential openings they tend to push their snouts against said openings with up-and-down and side-to-side thrusting actions. They do not spontaneously pull backward or upward on the material surrounding said openings. Said animals take the shortest route possible, having limited ability to discover that another approach while initially headed in the opposite direction, ultimately will prove more feasible. They also tend not to crawl down narrow passageways without some indication that the passageway is open at the other end.

One of the defects of presently-available pet doors is that once a curious animal pokes its nose through the typical external opening provided by said pet door, it can sense a draft and perhaps household odors, since breaching said external opening generally provides direct communication to the interior of the house. The odors and especially the draft indicate to the animal that the region to the other side of the partially-opened exterior door leads to a larger chamber. That is all the inducement needed by the typical small creature to continue its exploration. Very quickly it is inside the dwelling to the consternation of the owners of said dwelling, said owners, pets, and often the intruding animal itself.

By requiring the entering animal to pass through a series of doors, the initial one opening outward toward said animal and the final one opening inward, to achieve ingress, the Pet Portal overcomes the problem of the curious animal being let into the house. Even in the unlikely event in which the roaming dog, cat, skunk, raccoon, etc., does happen to lift the outermost door on the Pet Portal, it will not encounter inviting drafts and odors to lead it on. This is because the subsequent door or doors interdict any such drafts or odors. In this manner the Pet Portal excludes strange animals while presenting quite easy access to household pets trained in its operation. To train said household pets is a simple chore and one carried out by any of a number of methods. One such method is to prop the Pet Portal doors open during the training period, so that the pet receives all of the signals it needs in order to pursue the passage through said Pet Portal. The training is particularly effective if said pet is first physically helped through both doors and then, with both doors propped open, repeatedly placed outdoors when it wants to be indoors, and vice versa. The exclusivity feature of the Pet Portal depends crucially on the fact that ingress is achieved by a strategy quickly teachable to the household pets and yet one which unwanted animals are extremely unlikely to develop on their own.

PREFERRED EMBODIMENT

The Drawings depict the preferred embodiment of the invention. For definiteness, certain geometrical shapes are utilized in these drawings; the shapes chosen are not meant in any way as limiting constraints on the subject matter claimed. For example, the Drawings show a rectangular and fairly short passageway which the pet must traverse. In practice, the passageway may be circular and may be much longer, for example, where necessary to achieve the degree of indoor/outdoor isolation required by the invention. Furthermore, although the Pet Portal is described in its preferred embodiment as a pre-fabricated ready-to-install unit it should also be understood to encompass a component-by-component installation into the enclosed structure with which it is to be used. Finally, although the preferred embodiment may be inferred to be mounted in an exterior door of a house, it is to be understood that it can equally well be mounted in an exterior wall.

Figure 1:
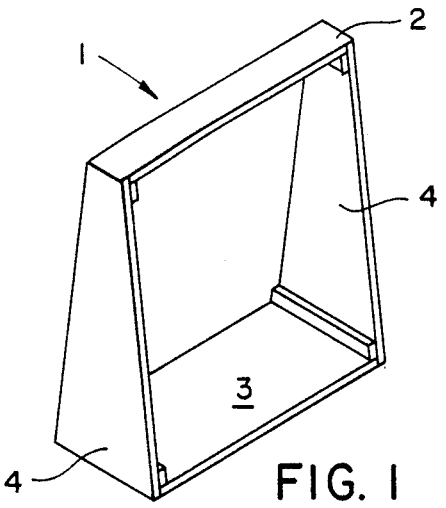
FIG. 1 is a perspective view of the Pet Portal frame by itself.

FIG. 1 depicts the frame 1 of the Pet Portal, which frame comprises a top sill 2, a bottom sill 3, and two trapezoidal-shaped side pieces 4 mutually affixed to one another so as to define a chamber open at two ends and with a rectangular cross-section normal to said chamber's longitudinal axis 12. The proximal and distal termini of said chamber are defined by the edges of said top and bottom sills, 2 and 3, and said side pieces 4. In order to provide a flat surface said edges are shaped so that for each terminus they all lie in the same plane.

Figure 2:
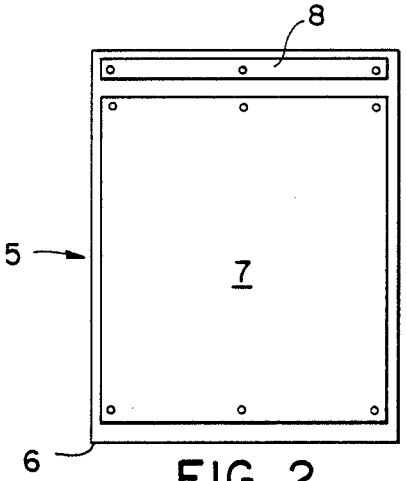
FIG. 2 is a front view of one of the two doors associated with the Pet Portal in its preferred form.

FIG. 2 depicts one of the Pet Portal doors 5, each of which in the preferred embodiment is hung from said top sill 2 of said frame 1. Said Pet portal door 5 comprises in major part a rectangular carpet-like flap 6 which is slightly greater in both height and width than is the outer rectangle defined collectively by said top sill 2, said bottom sill 3, and said side pieces 4 of said frame 1. Affixed to the center of said flap 6 by any convenient means is a planar stiffener 7. The purpose of said stiffener 7, which may be made of any durable planar material including but not limited to plywood, is to provide said flap 6 with both the weight and the planar surface needed to establish a tight seal when said compound door 5 hangs against said frame 1, while at the same time permitting the door to swing about a pivoting axis located at said top sill 2. For this purpose, said planar stiffener 7 has a width equal to the width dimension of said outer rectangle defined by members 2, 3, and 4 of said frame 1 and a height slightly less than that of said outer rectangle. Also affixed to said flap 6 is a narrow batten s, the function of which is to provide a means of rigidly aligning and affixing said flap 6 against said top sill 2.

Figure 3:
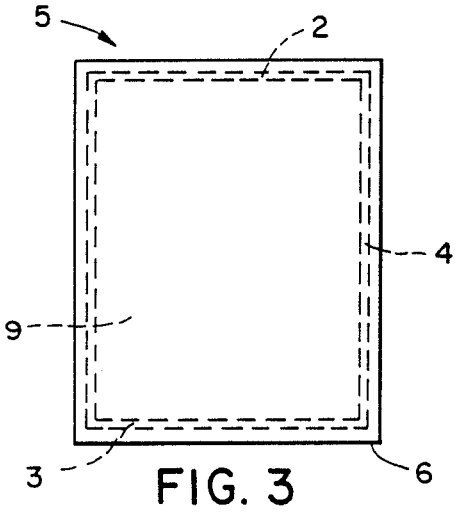
FIG. 3 is a front view of the installed Pet Portal, showing by hidden lines the relative position of the frame, door flap, and the aperture in the enclosed structure but not showing the door flap stiffener or batten.

FIG. 3 depicts the front view of said Pet Portal door 5 after it has been mounted on said frame 1 and said frame 1 has been installed in the aperture 9 cut in the enclosed structure 10 in association with which said Pet Portal is to be used. So as to be able to show more clearly the hidden lines defining the relationship between said aperture 9 and the elements of said frame 1, said stiffener 7 and said batten 8 have been deleted from the depiction in FIG. 3 of the installed Pet Portal. With continuing reference to FIG. 3, the outer perimeter of said door flap 6 is shown extending out beyond the rectangle defined by said frame 1 as installed in said aperture 9.

Figure 4:
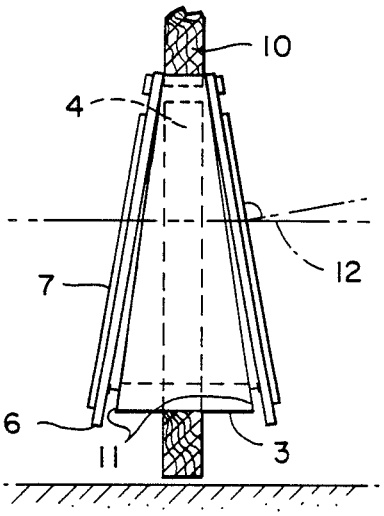
FIG. 4 is a side view of the fully-assembled and installed Pet Portal showing the two doors held temporarily ajar by nails at their respective bases.

FIG. 4 is a partially cut-away side view of the invention as installed and ready for use. The nails 11 shown propping open the Pet Portal flaps are used only during the pet training stage, when they allow the passage of air currents between the outdoors and the enclosed structure with which the Pet Portal is being used, hence providing a signal to the pet being trained that the Pet Portal offers passage into and out of said enclosed structure. Although the Pet Portal as depicted here has a top sill equal in one dimension to the thickness of the aperture into which the Portal is installed, this is not a necessary feature of the invention.

The trapezoidal nature of said side pieces 4 of said frame 1, particularly as illustrated by FIG. 1 and FIG. 4, ensure that the Pet Portal doors 5 will in their resting positions be oriented so that the normals to their respective planes will make an angle of 15–25 degrees with respect to the longitudinal axis 12 of the passageway defined by said frame 1. Because of this angle and the planar nature of the two surfaces constituting the interface between said doors 5 at rest and said frame 1, the force of gravity will maintain a weathertight seal at said interface. Furthermore, because both doors 5 open outwardly with respect to the passage defined by said frame 1, any pressure differential existing between the exterior and the interior of the enclosed structure in association with which the Pet Portal is being used will serve to reinforce that seal at one or the other of the doors 5, regardless of the direction of the gradient of said pressure differential. Such pressure differentials are the frequent result of wind; consequently, unlike much of the prior art, the present invention achieves an increase in tightness against the weather in the presence of wind.

Figure 5:
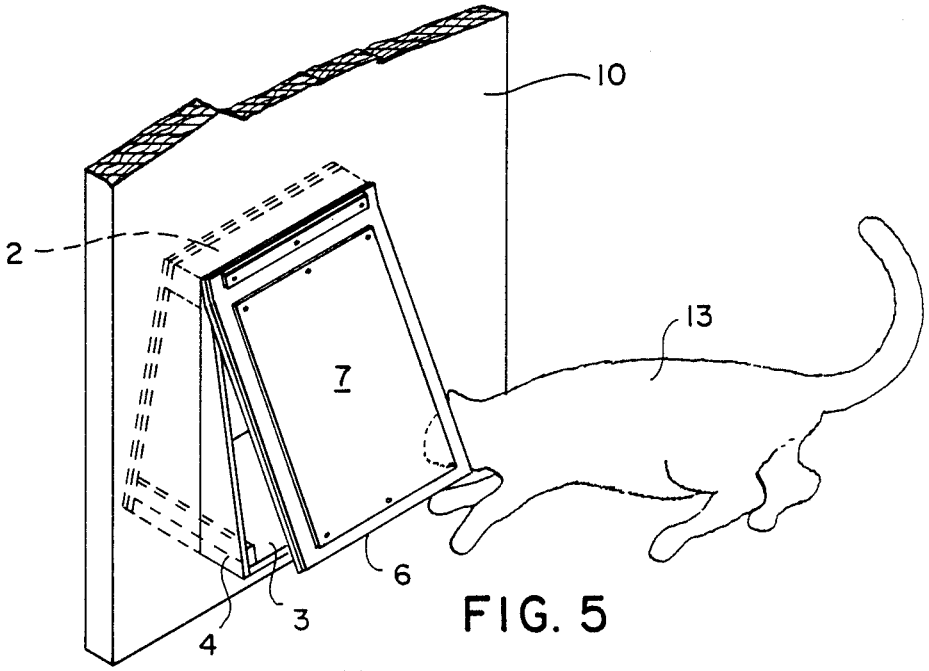
FIG. 5 is a perspective view of the installed Pet Portal showing an animal using its snout to raise and open the first door it encounters.

In addition to providing a passive means of sealing the Pet Portal's passageway when said passageway is not in use, the trapezoidal shape of said side pieces 4 goes to the heart of the "lock" feature of the invention by requiring an animal to lift the first door it encounters upward and backward toward itself. This is illustrated in part in FIG. 5, which shows the Pet Portal in use. In particular, it illustrates that the animal 13 needs to pull the outer door upward and outward in order to gain access. This is a non-spontaneous mode of behavior for an animal casually encountering the Pet Portal and this fact, along with the minimization of trans-passageway air currents when the Pet Portal doors 5 are closed, is the means by which this invention discourages passage by animals not trained in its use. Thus, it is the means by which the Pet Portal is equipped with a lock, the key to which can be given to pets through the brief training session when the Pet Portal is first installed.

I claim:

1. For use with an enclosed structure, a device for providing to selected pet animals easy, independent ingress to and from said structure while deterring passage to non-selected animals, comprising:

a frame which establishes a passageway between the exterior and interior of said enclosed structure, a plurality of doors depending from said frame and so arranged that all elements of said plurality of doors must be ajar concurrently in order for communication of air between the exterior and interior of said enclosed structure to occur, said plurality of doors comprising only two doors, one located on each of the exterior and the interior sides of said frame, that only open outwardly with respect to said passageway and which only move in opposing directions with respect to one another, a closing means utilizing gravity and the air pressure gradient along the length of said passageway in order to establish a weathertight seal between said frame and the distal and proximal elements of said plurality of doors, respectively.

2. The device as claimed in claim 1 wherein:

said frame comprises two trapezoidal side elements, a rectangular bottom element, and a rectangular top element, wherein said bottom and top elements are parallel to one another and affixed at right angles to said side elements, so as collectively to constitute said passageway, such that said passageway has a rectangular cross-section normal to its longitudinal axis, such that said passageway has greater longitudinal extent adjacent to said bottom element than it does adjacent to said top element, and such that the distal and proximal termini of said passageway are rectangular in shape and lie in planes with outward-pointing normals each making an acute angle with respect to said longitudinal axis of said passageway.

said plurality of doors comprises two compound doors affixed to said top element of said frame at said distal and proximal termini, respectively, each said compound door comprising a flexible fabric flap rectangular in shape and with area dimensions marginally greater than the outside dimensions of the rectangle defined by said frame elements at said termini of said passageway, and a stiff planar element rectangular in shape affixed to the center of said flap and having area dimensions equal to said outside dimensions of said rectangle defined by said frame elements at termini of said passageway, and where said compound doors are swingably suspended from said frame directly above the respective termini of said passageway, and said closing means comprises the force of gravity and ambient pressure gradient acting in concert to press said compound doors against the matching planar surfaces presented by said termini of said frame.

3. The device claimed in claim 1 wherein said frame comprises a tubular element the ends of which have been cut at an acute angle with respect to the longitudinal axis of said tubular element and which is tightly insertable through an aperture made in said enclosed structure where said aperture has inner dimensions equal to the outer dimensions of said tubular element and where said tubular element is oriented downward so as to constitute said passageway between the interior and exterior of said enclosed structure, and said plurality of doors comprises two rigid doors swingably suspended above the respective termini of said tubular element, and said closing means is the force of gravity and ambient pressure gradient acting in concert to press said rigid doors against the annular surface defined by said termini of said frame.

* * * * *